US010747143B2

(12) United States Patent
Nonaka et al.

(10) Patent No.: US 10,747,143 B2
(45) Date of Patent: Aug. 18, 2020

(54) DEVELOPER ACCOMMODATING UNIT, PROCESS CARTRIDGE, AND IMAGE FORMING APPARATUS

(71) Applicant: CANON KABUSHIKI KAISHA, Tokyo (JP)

(72) Inventors: Fumito Nonaka, Mishima (JP); Koji Yamaguchi, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/521,816

(22) Filed: Jul. 25, 2019

(65) Prior Publication Data

US 2020/0041931 A1 Feb. 6, 2020

(30) Foreign Application Priority Data

Jul. 31, 2018 (JP) ..... 2018-143129
Jul. 31, 2018 (JP) ..... 2018-143154

(51) Int. Cl.
*G03G 15/08* (2006.01)
*G03G 21/18* (2006.01)

(52) U.S. Cl.
CPC ..... *G03G 15/0881* (2013.01); *G03G 15/0886* (2013.01); *G03G 21/1814* (2013.01)

(58) Field of Classification Search
CPC ..... G03G 15/0881; G03G 15/0886; G03G 21/1676; G03G 21/1814; G03G 2215/067; G03G 2215/0692; G03G 2221/1648
See application file for complete search history.

(56) References Cited

U.S. PATENT DOCUMENTS

| | | | | |
|---|---|---|---|---|
| 8,983,342 | B2 | 3/2015 | Koyama et al. | |
| 9,599,932 | B2 | 3/2017 | Takeuchi et al. | |
| 2012/0099901 | A1* | 4/2012 | Sakai | G03G 15/0886 399/258 |
| 2017/0285516 | A1* | 10/2017 | Oniki | G03G 15/0886 |
| 2017/0285527 | A1* | 10/2017 | Okabe | G03G 15/0886 |

FOREIGN PATENT DOCUMENTS

| | | | |
|---|---|---|---|
| JP | 2013134401 | A | 7/2013 |
| JP | 2014167606 | A | 9/2014 |

* cited by examiner

*Primary Examiner* — Sophia S Chen

(74) *Attorney, Agent, or Firm* — Rossi, Kimms & McDowell LLP

(57) ABSTRACT

A developer accommodating unit includes a frame that has an opening for discharging a developer, and a sealing unit that has a sealing portion for sealing the opening, in which a state of the sealing unit is capable of changing from a first state in which the sealing portion seals the opening to a second state in which the opening is opened. A tip of a first part is positioned on a downstream side of the base of the first part in a first direction if the sealing unit is in the first state, and the first part is deformed such that the tip of the first part is positioned on an upstream side of the base of the first part in the first direction if the state of the sealing unit changes from the first state to the second state.

21 Claims, 13 Drawing Sheets

DEVELOPER ACCOMMODATING UNIT, PROCESS CARTRIDGE, AND IMAGE FORMING APPARATUS

BACKGROUND OF THE INVENTION

Field of the Invention

The present invention relates to an image forming apparatus, and a developer accommodating unit and a process cartridge used in the image forming apparatus.

Description of the Related Art

An electrophotographic image forming apparatus (hereinafter referred to as an apparatus main body) that uses a conventional electrophotographic image forming process adopts a process cartridge system in which a process cartridge obtained by integrating an electrophotographic photosensitive member and process means for operating on the electrophotographic photosensitive member is detachable from the apparatus main body. In the process cartridge system described above, an opening portion provided in a developer accommodating frame that accommodates a developer (toner, carrier, or the like) is sealed with a sealing member, and the process cartridge is shipped. When the process cartridge is used, a user peels off a joint portion of a toner seal serving as the sealing member to open the opening portion, and supply of the developer to the apparatus main body is allowed.

In recent years, Japanese Patent Application Publication No. 2014-167606 describes a configuration in which, in order to reduce a burden of a user, an opening is automatically opened by a driving force of an apparatus main body after a process cartridge is attached to the apparatus main body. In the configuration described in Japanese Patent Application Publication No. 2014-167606, a sealing member is peelably fixed to a developer container along the edge of the opening by thermal welding or the like. When a rotating member in the developer container for containing the developer rotates, the sealing member is wound around the rotating member, and the opening of the developer container is opened.

On the other hand, in a configuration described in Japanese Patent Application Publication No. 2013-134401, a sealing material is disposed between the outer peripheral surface of a shutter for opening and closing an opening portion of a toner cartridge and the inner peripheral surface of the toner cartridge, and the toner cartridge is opened by rotating the shutter. The shutter closes the opening portion in a state in which the sealing material is compressed by the shutter.

In the case of a compressed seal, an unsealing operation is started in a state in which the seal is compressed when opening is performed, and hence specific force is required.

SUMMARY OF THE INVENTION

An object of the present invention is to improve sealing performance of a seal while reducing an unsealing load of a compressed seal.

In order to achieve the object described above, a developer accommodating unit according to the present invention including:

a frame provided with a developer accommodating chamber configured to accommodate a developer, and an opening for discharging the developer from the developer accommodating chamber; and a sealing unit provided inside the frame, the sealing unit including a supporting portion rotatable in a first direction, and a sealing portion attached to the supporting portion, the sealing portion sealing the opening, the sealing portion having a protruding portion including a first part, the protruding portion being capable of coming into contact with the frame in a surrounding part of the opening, a state of the sealing unit being capable of changing from a first state in which the sealing portion seals the opening to a second state in which the opening is opened, wherein if the sealing unit is in the first state, a tip of the first part is positioned on a downstream side of a base of the first part in the first direction, and wherein if the state of the sealing unit changes from the first state to the second state, the first part is deformed such that the tip of the first part is positioned on an upstream side of the base of the first part in the first direction.

In order to achieve the object described above, a developer accommodating unit according to the present invention including:

a frame provided with a developer accommodating chamber configured to accommodate a developer, and an opening for discharging the developer from the developer accommodating chamber; and a sealing unit provided inside the frame, the sealing unit including a supporting portion rotatable in a first direction, and a sealing portion attached to the supporting portion, the sealing portion sealing the opening by being compressed by the frame and the supporting portion, the sealing portion having a protruding portion including a first part and a second part, the protruding portion being capable of coming into contact with the frame in a surrounding part of the opening, a state of the sealing unit being capable of changing from a first state in which the sealing portion seals the opening to a second state in which the opening is opened, wherein if the sealing unit is in the first state, the first part comes into contact with the frame on a downstream side of the opening in the first direction and is inclined from a base of the first part toward a tip of the first part in a direction from an upstream side of the opening toward the downstream side of the opening, and the second part comes into contact with the frame on the upstream side of the opening in the first direction and is inclined from a base of the second part toward a tip of the second part in a direction from the downstream side of the opening toward the upstream side of the opening, and a length from the base of the first part to the tip of the first part is greater than a thickness of the first part, and a length from the base of the second part to the tip of the second part is greater than a thickness of the second part when viewed in a direction of a rotational axis of the supporting portion.

Further features of the present invention will become apparent from the following description of exemplary embodiments (with reference to the attached drawings).

DESCRIPTION OF THE EMBODIMENTS

Embodiments of the present invention will now be described with reference to the drawings. Dimensions, materials, shapes of the components and the relative positions thereof described in the embodiments may be appropriately changed depending on the configuration of an apparatus to which the present invention is applied, and on various conditions, and are not intended to limit the scope of the invention to the following embodiments.

An image forming apparatus forms an image on a recording medium by using, e.g., an electrophotographic image forming process, and examples of the image forming apparatus include an electrophotographic copier, an electrophotographic printer (e.g., an LED printer, a laser beam printer, or the like), and an electrophotographic facsimile machine. A cartridge denotes a cartridge in which at least developing means and a developing apparatus that accommodates a developer are integrally configured and which is made detachable from an image forming apparatus main body, and a cartridge in which the developing apparatus and a photosensitive member unit having at least a photosensitive member are integrally configured and which is made detachable from the image forming apparatus main body.

Figure 1:
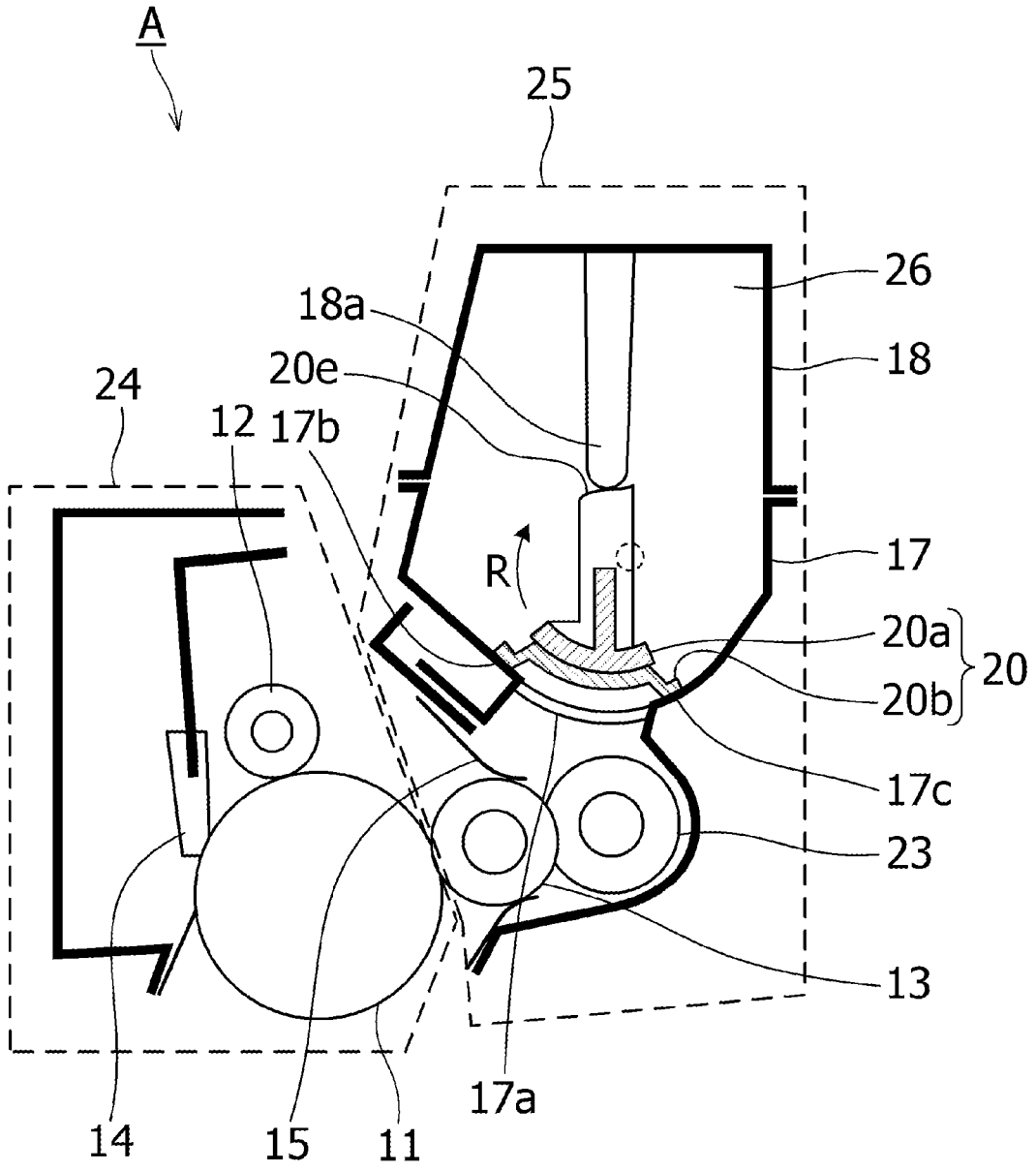
FIG. 1 is a cross-sectional view of a process cartridge having a developer accommodating unit in an embodiment.
Figure 2:
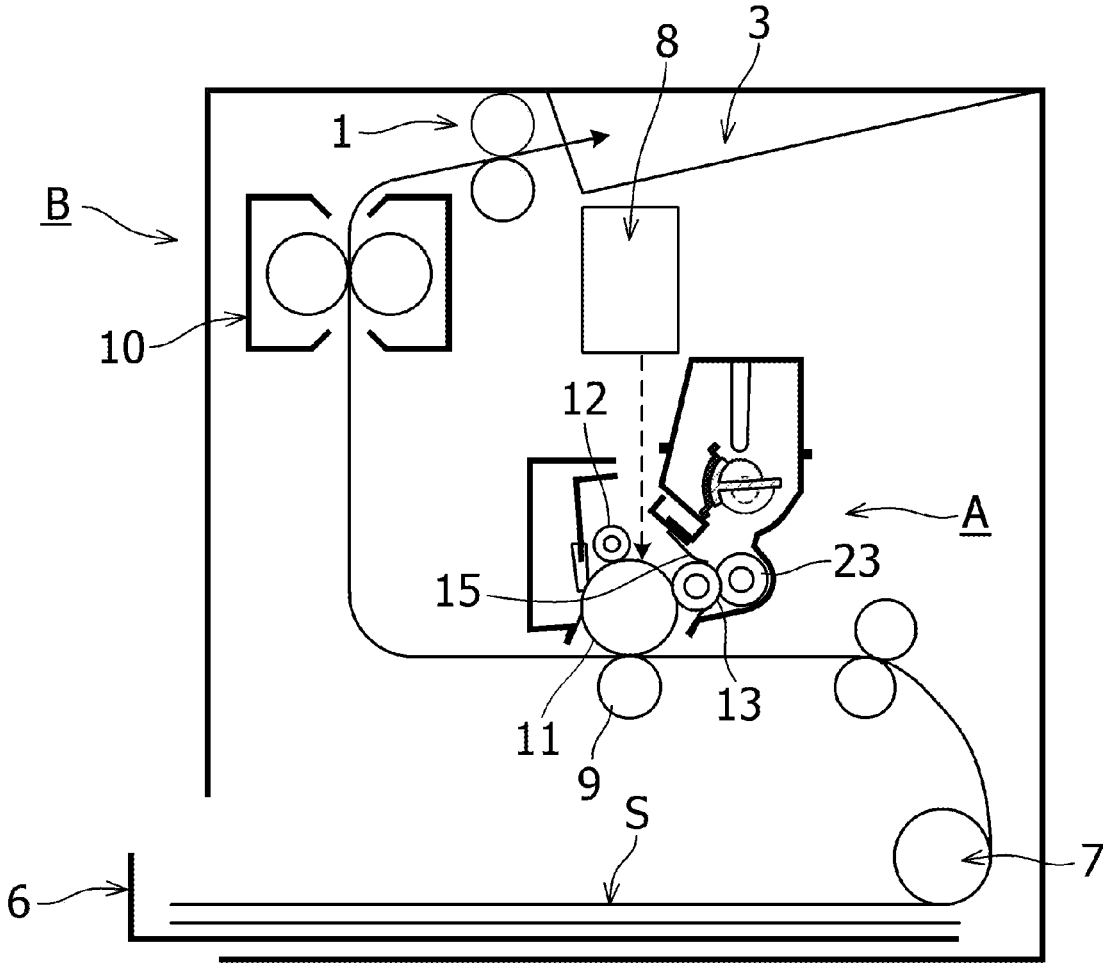
FIG. 2 is a cross-sectional view of an image forming apparatus in the embodiment.

FIG. 1 is a cross-sectional view of a process cartridge having a developer accommodating unit to which the present invention can be applied, and FIG. 2 is a cross-sectional view of an image forming apparatus to which the present invention can be applied.

Outline of Configuration of Process Cartridge

The process cartridge includes an image bearing member and process means for operating on the image bearing member. Examples of the process means include charging means for charging the surface of the image bearing member, a developing apparatus for forming an image on the image bearing member, and cleaning means for removing a developer (including toner and carrier) remaining on the surface of the image bearing member. As illustrated in FIG. 1, a process cartridge A of the present embodiment includes a cleaner unit 24. The cleaner unit 24 has a photosensitive drum 11 serving as the image bearing member, a charging roller 12 serving as the charging means, and a cleaning blade 14 that has elasticity and serves as the cleaning means. The charging roller 12 and the cleaning blade 14 are disposed around the photosensitive drum 11. In addition, the process cartridge A includes a developer accommodating unit 25 having a first frame 17 and a second frame 18. The process cartridge A is configured such that the cleaner unit 24 and the developer accommodating unit 25 are integrated with each other and, as illustrated in FIG. 2, the process cartridge A is detachable from an image forming apparatus main body B. The developer accommodating unit 25 includes a developing roller 13 serving as the developing means, a developing blade 15, a supply roller 23, and a developer accommodating chamber 26 that accommodates the developer. The developing roller 13 and the developing blade 15 are supported by the first frame 17.

Outline of Configuration of Image Forming Apparatus

The process cartridge A is attached to the image forming apparatus main body B illustrated in FIG. 2, and is used for image formation. In the image formation, a sheet (recording material) S is transported from a sheet cassette 6 attached to the lower part of the image forming apparatus main body B by a transport roller 7, the photosensitive drum 11 is selectively exposed by an exposure apparatus 8 in synchronization with the sheet transport, and a latent image is formed on the photosensitive drum 11. The developer is supplied to the developing roller (developer carrying member) 13 by the spongy supply roller 23, and the developing blade 15 causes the surface of the developing roller 13 to carry a thin layer of the developer. By applying a developing bias to the developing roller 13 and supplying the developer in accordance with the latent image, the latent image is developed into a developer image. With this, the developer image is formed on the photosensitive drum 11, and the photosensitive drum 11 bears the developer image. The developer image on the photosensitive drum 11 is transferred to the sheet S by applying a bias voltage to a transfer roller (transfer portion) 9. The sheet S is transported to a fixing apparatus 10, and the image is fixed to the sheet S by the fixing apparatus 10. The sheet S is discharged to a sheet discharge portion 3 in the upper part of the image forming apparatus main body B by a sheet discharge roller 1.

Configuration of Developer Accommodating Unit

Figure 3:
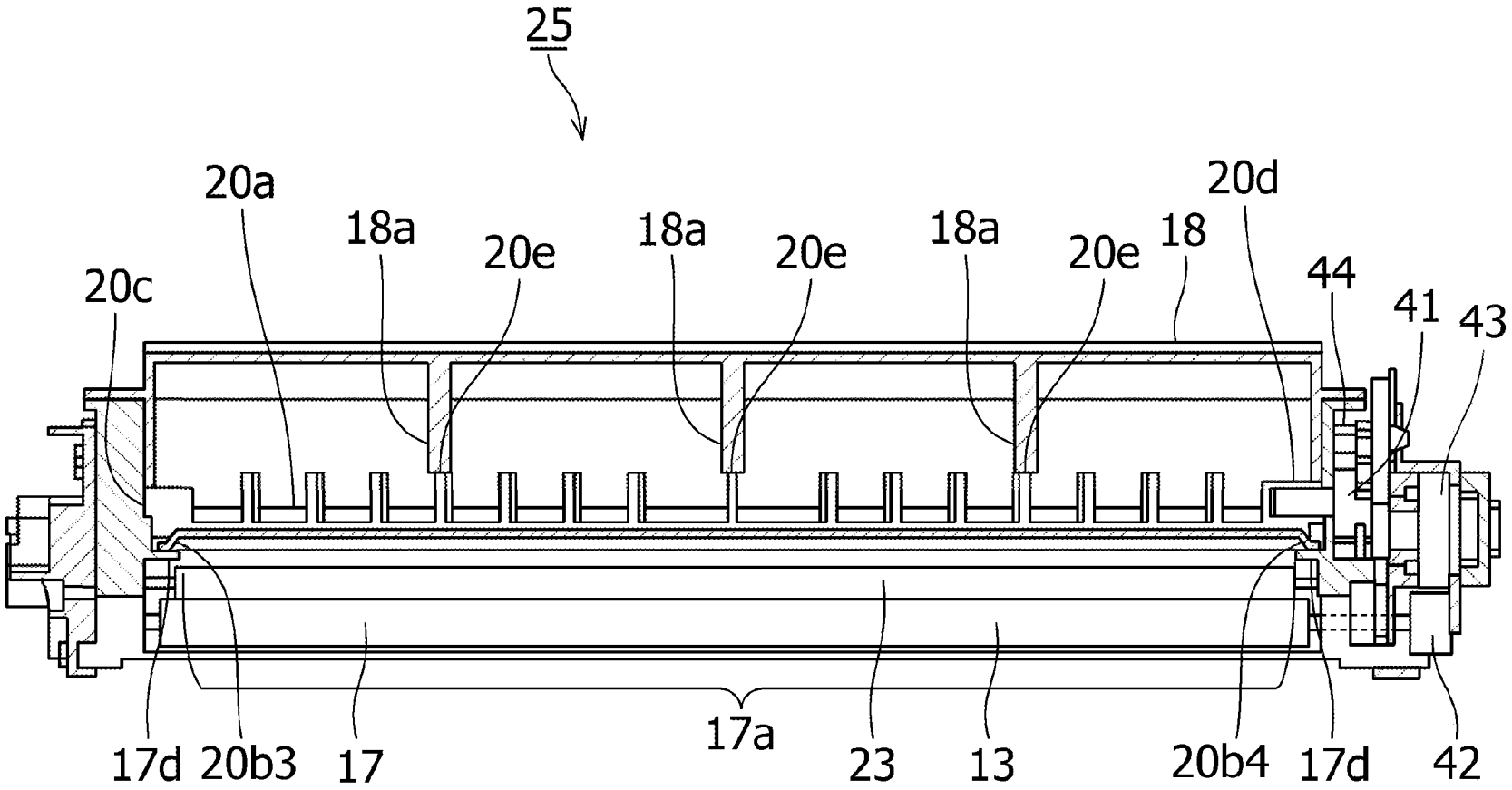
FIG. 3 is a cross-sectional view of the developer accommodating unit in the embodiment when viewed from a lateral direction of the developer accommodating unit.
Figure 4:
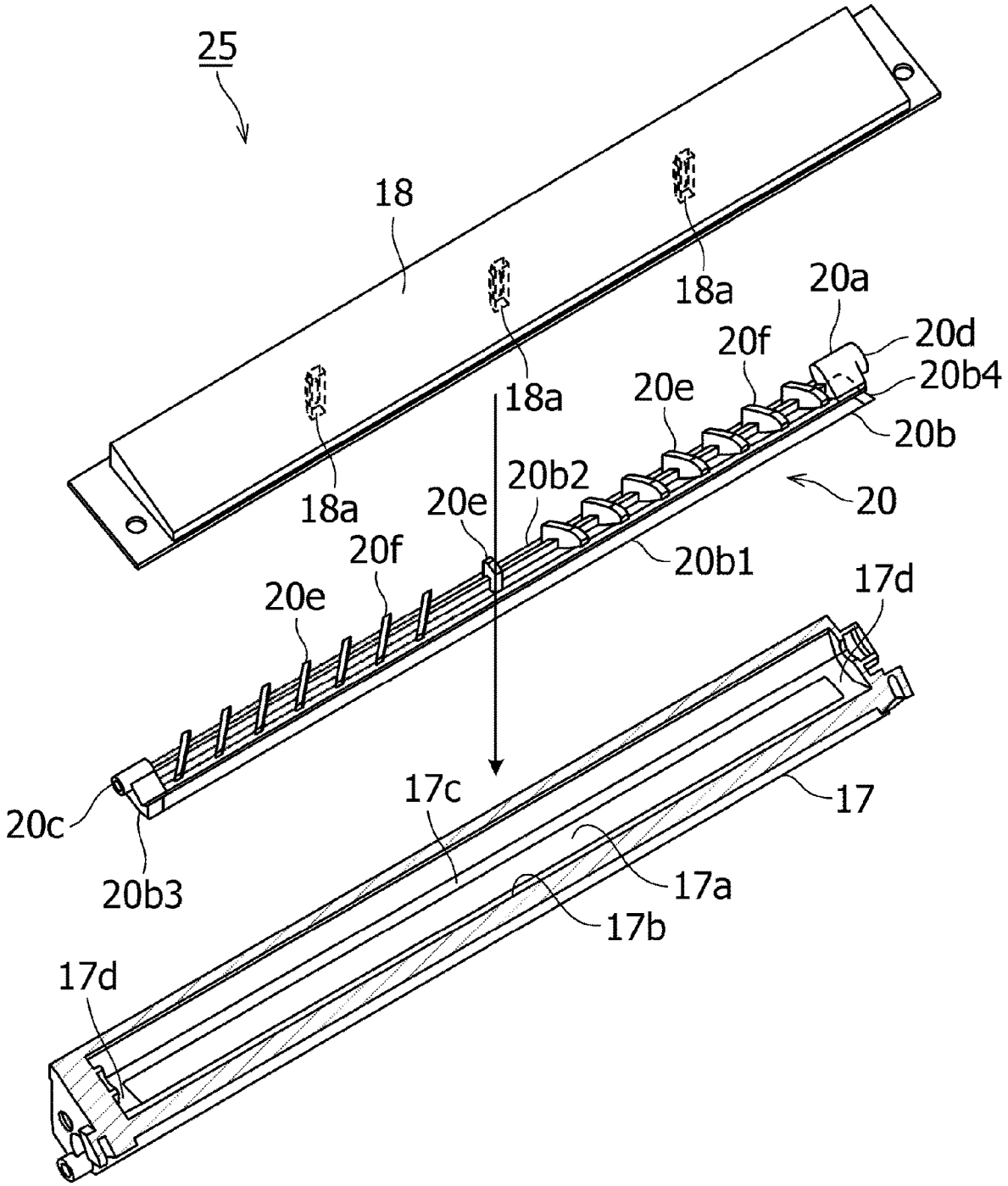
FIG. 4 is a perspective view illustrating assembly of the developer accommodating unit in the embodiment.

Next, the configuration of the developer accommodating unit 25 will be described by using FIG. 1, FIG. 3, and FIG. 4. FIG. 3 is a cross-sectional view in which the developer accommodating unit 25 is cut along the axis of the developing roller 13, i.e., a cross-sectional view of the developer accommodating unit 25 when viewed from a lateral direction of the developer accommodating unit 25. FIG. 4 is a perspective view illustrating assembly of the developer accommodating unit 25. Note that, in the following description, an axial direction of the developing roller 13 is defined as a longitudinal direction, and a direction orthogonal to the longitudinal direction is defined as a lateral direction. As illustrated in FIG. 1, in the developer accommodating unit 25, the first frame 17 that supports the developing roller 13 and the developing blade 15 and the second frame 18 are integrated with each other to constitute one developing frame (frame). The first frame 17 and the second frame 18 form the developer accommodating chamber 26 inside the developer accommodating unit 25. An opening 17*a* for discharging toner accommodated in the developer accommodating chamber 26 is provided in the lower part of the first frame 17 over a wide area in the longitudinal direction. In other words, the developing frame described above includes the developer accommodating chamber 26 and the opening 17*a*.

A sealing unit 20 for sealing the opening 17*a* is provided inside the developer accommodating chamber 26. In FIG. 1, the sealing unit 20 is provided inside the first frame 17. The sealing unit 20 is formed to extend in the longitudinal direction along the opening 17*a*, and a sealing portion 20*b* that has elasticity and a supporting portion 20*a* that supports the supporting portion 20*b* are integrally coupled to each other. As illustrated in FIG. 3, shaft portions 20*c* and 20*d* are provided at both ends of the supporting portion 20*a*, and the sealing unit 20 (the supporting portion 20*a*) is rotatably supported by the first frame 17. In addition, an unsealing gear 41 is coupled to the shaft portion 20*d* at one end (the right side in FIG. 3), and the sealing unit 20 and the unsealing gear 41 rotate integrally. Further, the unsealing gear 41 is engaged with an input gear 43 via an intermediate gear 44. When the process cartridge A is shipped, as illustrated in FIG. 1, the sealing unit 20 is disposed at a position that allows the sealing unit 20 to seal the opening 17*a* using the sealing portion 20*b*. When the process cartridge A is used, the input gear 43 is given drive from the image forming apparatus main body B to rotate, whereby the sealing unit 20 rotates in a direction of an arrow R in FIG. 1, and the opening 17*a* is opened. A state in which the sealing unit 20 (the sealing portion 20*b*) seals the opening 17*a* is referred to as a sealing state or a first state. When the sealing unit 20 is in the sealing state, the discharge of the toner from the opening 17*a* is prevented. In addition, a state in which the sealing unit 20 (the sealing portion 20*b*) is at a position that allows the opening 17*a* to be exposed is referred to as an unsealing state or a second state. When the sealing unit 20 is in the unsealing state, the opening 17*a* is opened. The discharge of the toner from the opening 17*a* is permitted. The supporting portion 20*a* can rotate about an axis (rotational axis) g described later. A direction in which the supporting portion 20*a* rotates such that a state of the sealing unit 20 changes from the sealing state to the unsealing state is referred to as an unsealing direction or a first direction (rotation direction R). Note that, after the sealing unit 20 is brought into the unsealing state, the sealing unit 20 can repeatedly move in a direction opposite to the rotation direction R (second direction) and in the rotation direction R in a range that does not allow the sealing unit 20 to seal the opening 17*a*. That is, after the sealing unit 20 is brought into the unsealing state, the sealing unit 20 can perform back-and-forth movement. The configuration of the sealing unit 20 will be described later in detail.

The developing roller 13 and the supply roller 23 for supplying the toner to the developing roller 13 are provided outside the developer accommodating chamber 26. Both ends of each of the developing roller 13 and the supply roller 23 in the longitudinal direction are rotatably supported by the first frame 17. A developing gear 42 is coupled to one end of the developing roller 13 in the longitudinal direction, and the developing gear 42 is engaged with the input gear 43. A gear that is not illustrated is coupled to one end of the supply roller 23 in the longitudinal direction, and the gear that is not illustrated is engaged with the input gear 43. With the rotation of the input gear 43, the developing roller 13 and the supply roller 23 rotate together with the unsealing gear 41. In addition, as illustrated in FIGS. 3 and 4, a plurality of rib-like pressing portions 18*a* protrude toward the opening 17*a* (downward in FIGS. 3 and 4) from the inner top surface of the second frame 18. Each pressing portion 18*a* is provided at a position that is inside the second frame 18 and faces the opening surface of the opening 17*a*, and comes into contact with a pressed portion 20*e* provided in the sealing unit 20 in the sealing state. The sealing portion 20*b* is attached to the supporting portion 20*a* and is held between the first frame 17 and the supporting portion 20*a* to thereby seal the opening 17*a*. In other words, the sealing portion 20*b* is pressed against the surrounding part of the opening 17*a* in the first frame 17 and is compressed by the supporting portion 20*a*. That is, the sealing portion 20*b* is compressed by the supporting portion 20*a* and the first frame 17. Subsequently, the opening 17*a* is sealed by the sealing portion 20*b*. That is, the sealing portion 20*b* can come into contact with the first frame 17 in the surrounding part of the opening 17*a*. The sealing state denotes a state in which the sealing unit 20 seals the opening 17*a*. The function of the pressing portion 18*a* will be described later.

Detailed Configuration of Sealing Unit 20

Figure 5A:
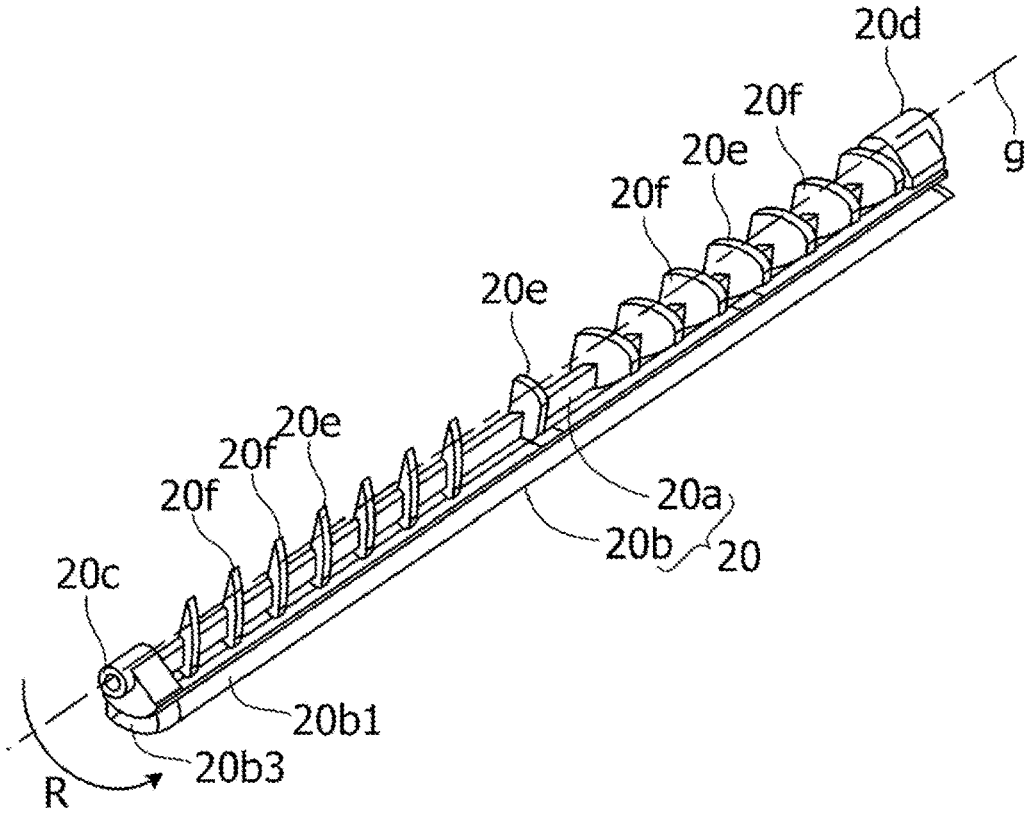
FIGS. 5A and 5B are perspective views of a sealing unit in the embodiment.
Figure 5B:
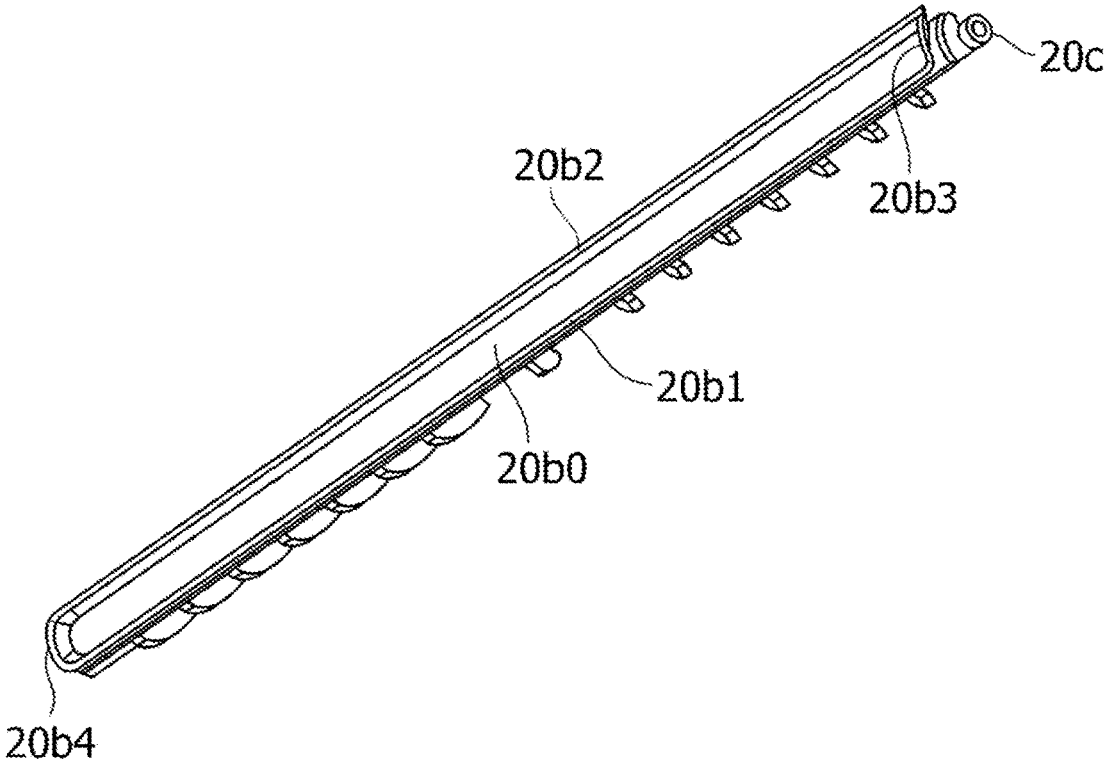
Figure 6A:
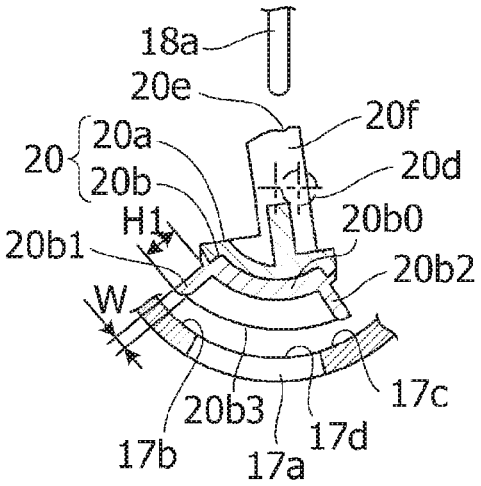
FIGS. 6A to 6E are cross-sectional views of the sealing unit in the embodiment.
Figure 6B:
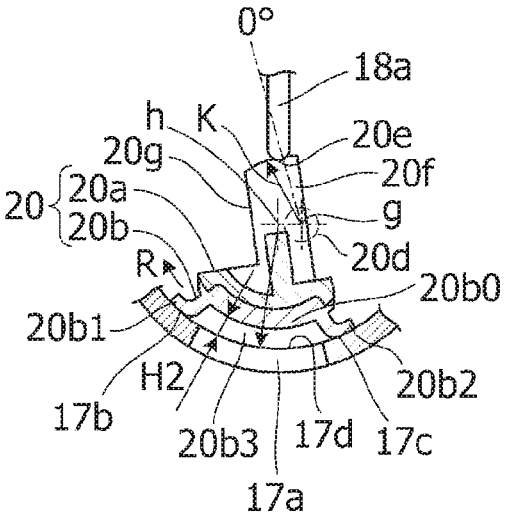
Figure 6C:
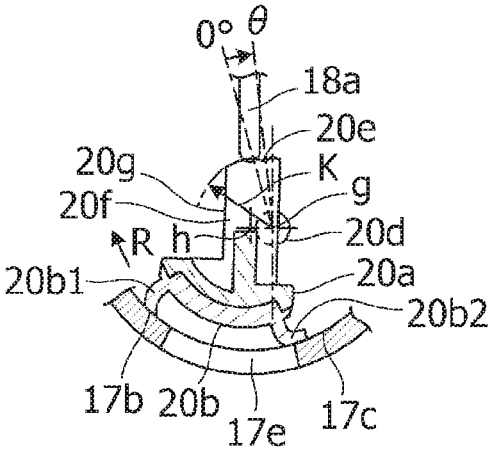
Figure 6D:
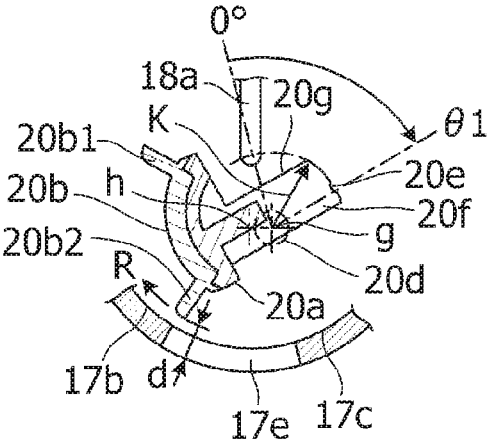
Figure 6E:
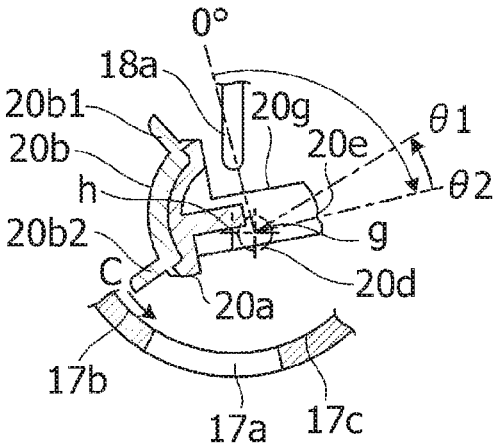
Figure 11:
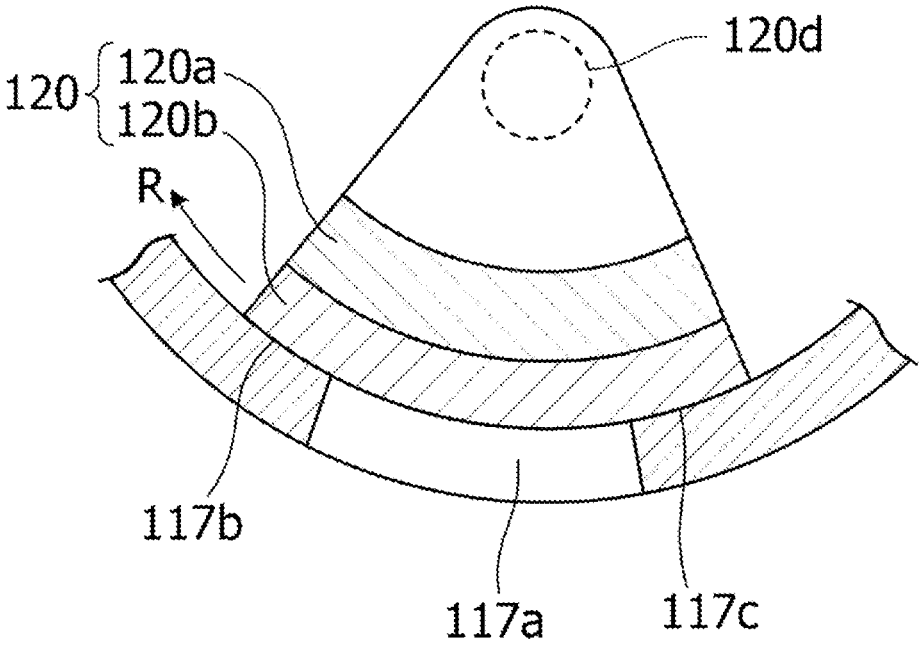
FIG. 11 is a cross-sectional view of a sealing unit in a comparative example.
Figure 12A:
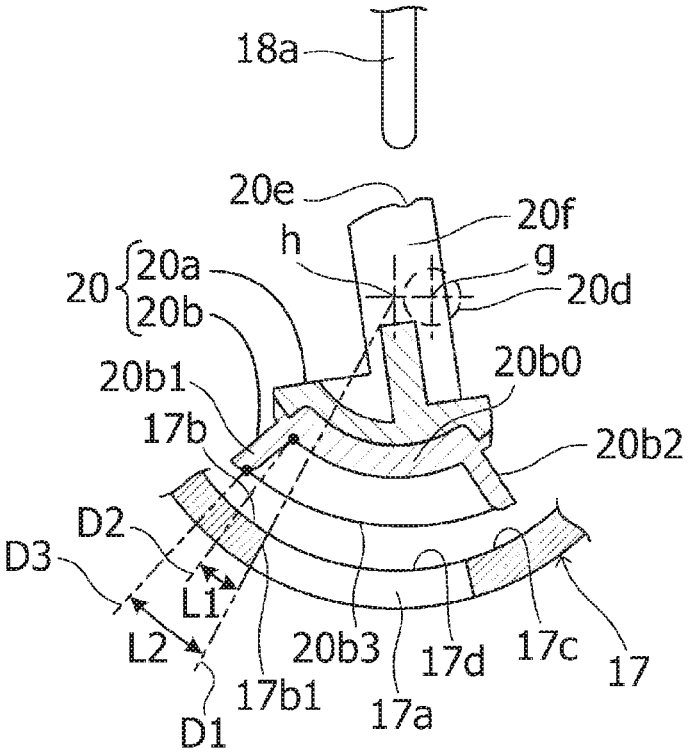
FIGS. 12A and 12B are cross-sectional views of the sealing unit in the embodiment.
Figure 12B:
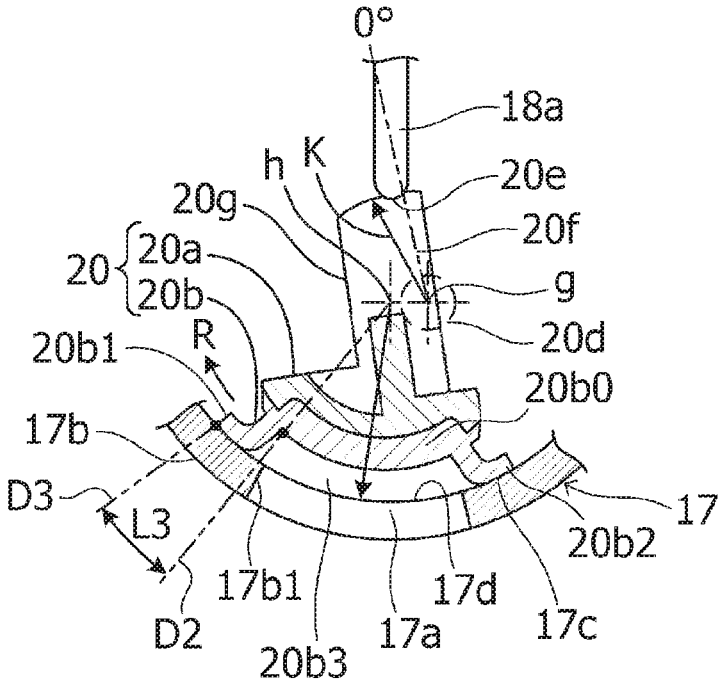

Next, the detailed configuration of the sealing unit 20 will be described by using FIG. 4, FIGS. 5A and 5B, FIGS. 6A to 6E, FIG. 11, and FIGS. 12A and 12B. FIGS. 5A and 5B are perspective views of the sealing unit 20, and FIGS. 6A to 6E and FIGS. 12A and 12B are cross-sectional views of the sealing unit 20. FIG. 6A illustrates a state before the sealing unit 20 is incorporated in the developer accommodating chamber 26, and FIG. 6B illustrates a state in which the sealing unit 20 is incorporated in the developer accommodating chamber 26. FIGS. 6C to 6E are views for explaining the unsealing operation of the sealing unit 20. FIG. 11 is a cross-sectional view of a sealing unit 120 in a comparative example. FIG. 12A is a view obtained by enlarging FIG. 6A and adding dimensions to FIG. 6A for explanation. Similarly, FIG. 12B is a view obtained by enlarging FIG. 6B and adding dimensions to FIG. 6B. As described above, the sealing unit 20 includes the supporting portion 20*a* and the sealing portion 20*b* having elasticity. In the present embodiment, an elastomer resin is used as the material of the sealing portion 20*b*, and a polystyrene resin is used as the material of the supporting portion 20*a*. In this case, the rigidity of the sealing portion 20*b* is lower than the rigidity of the supporting portion 20*a*. With regard to a manufacturing method thereof, the sealing portion 20*b* and the supporting portion 20*a* may be manufactured separately and joined to each other, and the supporting portion 20*a* and the sealing portion 20*b* may also be formed integrally by using the elastomer resin as the material of the supporting portion 20*b*. The step of joining the two members becomes unnecessary by integrally forming the supporting portion 20*a* and the sealing portion 20*b*, and it is possible to achieve an improvement in productivity. The material of the sealing portion 20*b* is not limited to the elastomer resin. Another elastic material may be used as the material of the sealing portion 20*h*, and the material thereof is not limited to the elastomer resin as long as the material is properly shaped and set such that sealability for the toner in a container is maintained and a load for unsealing does not become higher than a conventional load, as will be described later.

Next, the shape of the sealing portion 20*b* will be described in detail. The sealing portion 20*b* has a base portion 20*b*0, and a protruding portion including lips 20*b*1 to 20*b*4. When the sealing unit 20 is in the sealing state, the protruding portion of the sealing portion 20*b* comes into contact with the first frame 17 in the surrounding part of the opening 17*a*. As illustrated in FIG. 5B, in the sealing portion 20*b* the lips 20*b*1 to 20*b*4 that linearly protrude from the slender rectangular base portion 20*b*0 are formed to extend along the peripheral part of the base portion 20*b*0. That is, the lips 20*b*1 to 20*b*4 are provided to stand on the peripheral part of the base portion 20*b*0, and a frame member is formed in the peripheral part of the base portion 20*b*0 by the lips 20*b*1 to 20*b*4. The lips 20*b*1 to 20*b*4 protrude from the base portion 20*b*0 to a side opposite to the side of the supporting portion 20*a*. The upper surface of the base portion 20*b*0 is a joint surface that is joined to the supporting portion 20*a*. In the rotation direction R, the lip 20*b*1 is positioned on a downstream side of the lip 20*b*2. The lip 20*b*1 and the lip 20*b*2 extend in a direction of the rotational axis (the axis g) of the supporting portion 20*a*. That is, the longitudinal direction of each of the lip 20*b*1 and the lip 20*b*2 matches the direction of the rotational axis (the axis g) of the supporting portion 20*a*. The lip 20*b*3 and the lip 20*b*4 extend in a direction (the rotation direction of the supporting portion 20*a*) intersecting the rotational axis (the axis g) of the supporting portion 20*a*. That is, the longitudinal direction of each of the lip 20*b*3 and the lip 20*b*4 matches the direction (the rotation direction of the supporting portion 20*a*) intersecting the rotational axis (the axis g) of the supporting portion 20*a*. Each of the inner surfaces of the lips 20*b*1 to 20*b*4 faces the inner direction of the base portion 20*b*0. Each of the outer surfaces of the lips 20*b*1 to 20*b*4 faces the outer direction of the base portion 20*b*0. The inner surface of the lip 20*b*1 and the inner surface of the lip 20*b*2 face each other, and the inner surface of the lip 20*b*3 and the inner surface of the lip 20*b*4 face each other. In the case of the sealing state, as illustrated in FIG. 6B, the lips 20*b*1 to 20*b*4 are disposed so as to surround the periphery of the opening 17*a*. That is, in the case of the sealing state, the supporting portion 20*a* biases the lips 20*b*1 to 20*b*4 toward the surrounding part of the opening 17*a* in the first frame 17, and the lips 20*b*1 to 20*b*4 come into contact with the surrounding part of the opening 17*a* in the first frame 17. When the sealing unit 20 is in the sealing state, in the rotation direction R, the tip of the lip 20*b*1 (a first part) is positioned on the downstream side of the base of the lip 20*b*1, and the tip of the lip 20*b*2 (a second part) is positioned on an upstream side of the base of the lip 20*b*2. In the sealing state, the lips 20*b*1 and 20*b*2 disposed on the long sides of the base portion 20*b*0 are deformed into shapes conforming to arc shapes of contacted portions 17*b* and 17*c* of the first frame 17. In addition, in the sealing state, each of the lips 20*b*3 and 20*b*4 disposed on the short sides of the base portion 20*b*0 is deformed into a shape conforming to an arc shape of a contacted portion 17*d* of the first frame 17. The contacted portions 17*b*, 17*c*, and 17*d* are inner parts of the first frame 17, and are included in the surrounding part of the opening 17*a* in the first frame 17.

With regard to cross-sectional dimensions of each of the lips 20*b*1 to 20*b*4, as illustrated in FIG. 6A, for example, a height H1 is 2.8 mm, and a width W is 1 mm. In the case where the sealing unit 20 is in the sealing state (FIG. 6B), the sealing portion 20*b* deforms and the sealing unit 20 is supported by the first frame 17. For example, a distance H2 between the base portion 20*b*0 of the sealing portion 20*b* and the opening 17*a* at this point is 2.1 mm. The sealing portion 20*b* deforms, and H1>H2 is thereby satisfied.

Figure 13:
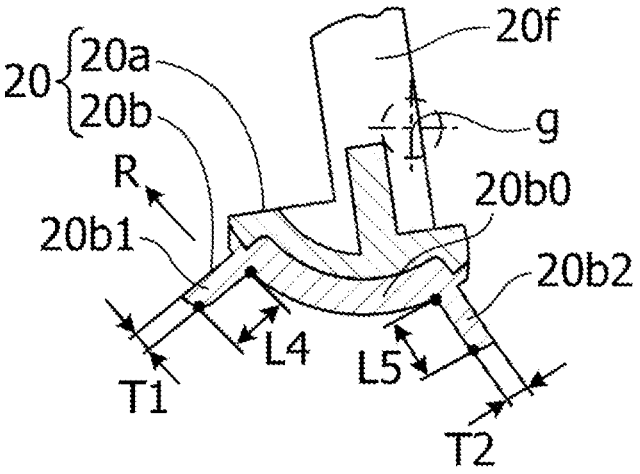
FIG. 13 is a cross-sectional view of the sealing unit in the embodiment.

The tip shape of each of the lips 20*b*1 to 20*b*4 will be specifically described by using FIGS. 12A and 12B and FIG. 13. A distance L1 from a line D1 passing through an end surface 17*b*1 of the opening 17*a* to a line D2 passing through the base of the lip 20*b*1 is less than a distance L2 from the line D1 passing through the end surface 17*b*1 to a line D3 passing through the tip of the lip 20*b*1. That is, the lip 20*b*1 is provided in the base portion 20*b*0 such that the distance L1<the distance L2 is satisfied. The same applies to each of the lips 20*b*2 to 20*b*4. The base of the lip 20*b*1 is a boundary part between the base portion 20*b*0 and the lip 20*b*1. The line D2 is a line drawn from the base of the lip 20*b*1 to the contacted portion 17*b* of the first frame 17. The line D3 is a line drawn from the tip of the lip 20*b*1 to the contacted portion 17*b* of the first frame 17. The distance L2 is greater than the distance L1. Consequently, the lip 20*b*1 is inclined toward the outer side of the base portion 20*b*0. Similarly, the lips 20*b*2 to 20*b*4 are inclined toward the outer side of the base portion 20*b*0.

As illustrated in FIG. 12B, the sealing unit 20 is incorporated in the developer accommodating chamber 26. In the state in which the sealing portion 20*b* seals the opening 17*a*, the tip of the lip 20*b*1 is in contact with the contacted portion 17*b*, and the tip of the lip 20*b*2 is in contact with the contacted portion 17*c*. That is, when the sealing unit 20 is in the sealing state, in the rotation direction R, the lip 20*b*1 comes into contact with the first frame 17 on the downstream side of the opening 17*a*. In the rotation direction R, the lip 20*b*2 comes into contact with the first frame 17 on the upstream side of the opening 17*a*. At this point, the supporting portion 20*a* is pressed by the pressing portion 18*a*, and the lips 20*b*1 to 20*b*4 are deformed. In this case, the lip 20*b*1 is inclined from the base of the lip 20*b*1 toward the tip thereof in a direction from the upstream side of the opening 17*a* toward the downstream side thereof. In addition, the lip 20*b*2 is inclined from the base of the lip 20*b*2 toward the tip thereof in a direction from the downstream side of the opening 17*a* toward the upstream side thereof. The upstream side of the opening 17*a* matches the upstream side of the sealing unit 20 in the rotation direction. The downstream side of the opening 17*a* matches the downstream side of the sealing unit 20 in the rotation direction.

The lip 20*b*1 is inclined in a direction in which the tip of the lip 20*b*1 moves away from the opening 17*a* further as compared with the position of the tip of the lip 20*b*1 in the state (FIG. 12A) before the tip of the lip 20*b*1 comes into contact with the contacted portion 17*b*. In other words, a distance L3 between the line D2 and the line D3 in the lip 20*b*1 in FIG. 12B is greater than a distance (L2−L1) between the line D2 and the line D3 in the lip 20*b*1 in FIG. 12A. That is, when the sealing unit 20 is incorporated in the developer accommodating chamber 26, the lip 20*b*1 comes into contact with the contacted portion 17*b* in a state in which the tip of the lip 20*b*1, which is inclined before the sealing unit 20 is incorporated in the developer accommodating chamber 26, is bent in a specific direction. In other words, part of the inner surface of the lip 20*b*1 comes into contact with the surrounding part of the opening 17*a* in the first frame 17, and part of the inner surface of the lip 20*b*2 comes into contact with the surrounding part of the opening 17*a* in the first frame 17. This deformation takes place over the entire periphery of the sealing portion 20*b*, and the lips 20*b*1 to 20*b*4 come into contact with the surrounding part of the opening 17*a* in the first frame 17 in a state in which each of the tips of the lips 20*b*1 to 20*b*4 is bent in a direction away from the opening 17*a*.

As illustrated in FIG. 13, when viewed in the direction of the rotational axis (the axis g) of the supporting portion 20*a*, a length L4 from the base of the lip 20*b*1 to the tip thereof is greater than a thickness T1 of the lip 20*b*1, and a length L5 from the base of the lip 20*b*2 to the tip thereof is greater than a thickness T2 of the lip 20*b*2. Note that viewing in the direction of the rotational axis (the axis g) denotes that an object projected on a plane orthogonal to the rotational axis (the axis g) is viewed along the direction of the rotational axis. Accordingly, the lip 20*b*1 and the lip 20*b*2 are easily bent in the rotation direction R of the sealing unit 20. In the present embodiment, the length L4, the thickness T1, the length L5, and the thickness T2 are measured in the following manner. In a protruding direction of the lip 20*b*1, the length of a part of the lip 20*b*1 that protrudes from the base portion 20*b*0 is the length L4 from the base of the lip 20*b*1 to the tip thereof. In a direction that is orthogonal to the protruding direction of the lip 20*b*1 and extends along the rotation direction R of the sealing unit 20, a distance between the outer surface of the lip 20*b*1 and the inner surface opposite to the outer surface is the thickness T1 of the lip 20*b*1. In a protruding direction of the lip 20*b*2, the length of a part of the lip 20*b*2 that protrudes from the base portion 20*b*0 is the length L5 from the base of the lip 20*b*2 to the tip thereof. In a direction that is orthogonal to the protruding direction of the lip 20*b*2 and extends along the rotation direction R of the sealing unit 20, a distance between the outer surface of the lip 20*b*2 and the inner surface opposite to the outer surface is the thickness T2 of the lip 20*b*2.

In the configuration of the embodiment, the lip 20*b*1 is provided in the base portion 20*b*0 such that the length L4 from the base of the lip 20*b*1 to the tip thereof is greater than the thickness T1 of the lip 20*b*1. In addition, in the configuration of the embodiment, the lip 20*b*2 is provided in the base portion 20*b*0 such that the length L5 from the base of the lip 20*b*2 to the tip thereof is greater than the thickness T2 of the lip 20*b*2. Each of the lip 20*b*3 and the lip 20*b*4 also has a shape in which the length is greater than the thickness. A thickness direction of each of the lip 20*b*3 and the lip 20*b*4 matches the direction of the rotational axis of the supporting portion 20*a*. With this, the lip 20*b*1 and the lip 20*b*2 are easily bent, and hence, even in the case where the pressure of the sealing portion 20*b* that biases the surrounding part of the opening 17*a* in the first frame 17 is low, the sealing state is maintained. By reducing the biasing pressure applied to the surrounding part of the opening 17*a* in the first frame 17, it is possible to reduce a load when the opening 17*a* is opened. Consequently, it is possible to improve the sealing performance of the sealing unit 20 while reducing the unsealing load of the compressed sealing unit 20. In addition, since the lip 20*b*1 and the lip 20*b*2 are easily bent in the rotation direction R of the sealing unit 20, the sealing unit 20 can rotate in the state in which the lip 20*b*1 and the lip 20*b*2 are bent, and the load when the opening 17*a* is opened is reduced. Note that, in the case where the thickness T1 of the lip 20*b*1 is greater than the length L4 from the base of the lip 20*b*1 to the tip thereof, the lip 20*b*1 is not easily bent in the rotation direction R of the sealing unit 20. In addition, in the case where the thickness 12 of the lip 20*b*2 is greater than the length L5 from the base of the lip 20*b*2 to the tip thereof, the lip 20*b*2 is not easily bent in the rotation direction R of the sealing unit 20.

In the case where the distance L1 between the line D1 and the line D2 is equal to the distance L2 between the line D1 and the line D3 (L1=L2), the direction of bend of the lip 20*b*1 is not stabilized when the sealing unit 20 is incorporated in the developer accommodating chamber 26. In the case where the lips 20*b*1 to 20*b*4 are bent nonuniformly, it is feared that the toner may leak from a gap between the lips 20*b*1 to 20*b*4 and the surrounding part of the opening 17*a* in the first frame 17. In addition, in the embodiment, each of the tips of the lips 20*b*1 to 20*b*4 faces a direction away from the opening 17*a*, i.e., a direction of an accommodation area of the toner. The individual tips of the lips 20*b*1 to 20*b*4 of the sealing portion 20*b* are pressed against the contacted portions 17*b*, 17*c*, and 17*d* by toner powder pressure in the developer accommodating chamber 26, and hence the sealing performance is more excellent than that of the configuration in which each of the tips of the lips 20*b*1 to 20*b*4 faces a direction approaching the opening 17*a*. Note that each of corner portions at which the lips 20*b*1 and 20*b*2 disposed on the long sides of the base portion 20*b*0 intersect the lips 20*b*3 and 20*b*4 disposed on the short sides of the base portion 20*b*0 has an arc shape (FIG. 5B).

With the foregoing, the sealing portion 20*b* is held between the contacted portions 17*b*, 17*c*, and 17*d* (FIG. 4) of the entire periphery of the opening 17*a* and the supporting portion 20*a*, and the directions in which the lips 20*b*1 to 20*b*4 are bent are constant due to the contact of the sealing portion 20*b* with the contacted portions 17*b*, 17*c*, and 17*d*. Accordingly, the sealing state is stably maintained.

In addition, as illustrated in FIG. 6A, in the supporting portion 20*a*, the pressed portion 20*e* is provided at a position that is on a side opposite to the side of the sealing portion 20*b* and faces the pressing portion 18*a*. The pressing portion 18*a* comes into contact with the pressed portion 20*e*, the sealing portion 20*b* slightly deforms, and the sealing unit 20 maintains the sealing state (FIG. 6B). That is, in the case where the pressed portion 20*e* comes into contact with the pressing portion 18*a*, the lips 20*b*1 to 20*b*4 come into contact with the surrounding part of the opening 17*a* in the first frame 17 in a state in which the shapes of the lips 20*h*1 to 20*b*4 are deformed. With this, the supporting portion 20*a* is warped due to the elasticity of the sealing portion 20*b*, and the sealing performance can be thereby prevented from being reduced. In addition, it is possible to prevent leakage of the toner from the opening 17*a* caused by the deformation of the sealing unit 20 that results from vibrations or the like during distribution. Further, by providing the pressing portion 18*a* in the second frame 18, the bending rigidity of the supporting portion 20*a* can be reduced to a level lower than that in the case where the pressing portion 18*a* is not provided in the second frame 18. In addition, the provision of the pressing portion 18*a* in the second frame 18 contributes to saving of the material of the supporting portion 20*a* and a reduction in the weight of the supporting portion 20*a*. Note that, with regard to the number of the pressing portions 18*a*, in the embodiment, the pressing portions 18*a* are provided at three places in the second frame 18, but the number of the pressing portions 18*a* may be appropriately selected according to the rigidity of the supporting portion 20*a* and the elasticity of the sealing portion 20*b*. The number of the pressed portions 20*e* is selected according to the number of the pressing portions 18*a*.

When the sealing unit 20 receives the drive from the image forming apparatus main body B, as illustrated in FIG. 6B, the sealing unit 20 rotates in the direction of the arrow R about the axis g joining the shaft portions 20*c* and 20*d* at both ends. Herein, the sealing unit 120 in the comparative example in FIG. 11 will be described. The sealing unit 120 in the comparative example includes a supporting portion 120*a* and a rectangular sponge 120*b*, and the sponge 120*b* covers an opening 117*a*. The sealing unit 120 is rotatably supported via a shaft portion 120*d*. In the comparative example, when the unsealing of the opening 117*a* is started, the sponge 120*b* slides on and rubs against contacted portions 117*b* and 117*c* while maintaining a compressed state. In contrast, in the configuration of the sealing unit 20 in the embodiment, as illustrated in FIG. 6C, the tip of the lip 20*b*1 on the downstream side in the rotation direction R is inverted inwardly without sliding from the position where the tip thereof is in contact with the contacted portion 17*b*. That is, when a state of the sealing unit 20 changes from the sealing state to the unsealing state, the tip of the lip 20*b*1 is positioned on the upstream side of the base of the lip 20*b*1 in the rotation direction R of the sealing unit 20, and the tip of the lip 20*b*2 is positioned on the upstream side of the base of the lip 20*b*2 in the rotation direction R of the sealing unit 20. In other words, when a state of the sealing unit 20 changes from the sealing state to the unsealing state, the lip 20*b*1 is deformed such that the tip of the lip 20*b*1 is positioned on the upstream side of the base of the lip 20*b*1 in the rotation direction R. On the other hand, when a state of the sealing unit 20 changes from the sealing state to the unsealing state, the tip of the lip 20*b*2 is positioned on the upstream side of the base of the lip 20*b*2 in the rotation direction R. That is, the inclination direction of the lip 20*b*2 does not change. The unsealing state denotes a state in which the sealing unit 20 opens the opening 17*a*. In this case, part of the outer surface of the lip 20*b*1 comes into contact with the surrounding part of the opening 17*a* in the first frame 17, and part of the inner surface of the lip 20*b*2 comes into contact with the surrounding part of the opening 17*a* in the first frame 17. Thereafter, the lip 20*b*1 slides while being inverted inwardly. Consequently, according to the configuration of the embodiment, the load of the unsealing can be made lower than that in the configuration of the comparative example in which the rectangular sponge 120*b* is used. As described above, the lip 20*b*1 and the lip 20*b*2 are easily bent in the rotation direction R of the sealing unit 20, and hence, even in the case where the tip of the lip 20*b*1 is not inverted inwardly, the load of the unsealing in the configuration of the embodiment is lower than that in the configuration of the comparative example in which the rectangular sponge 120*b* is used. In addition, in the configuration of the embodiment, the toner is easily transported especially by the lip 20*b*1 and the lip 20*b*2.

On the surface of the pressed portion 20*e* that is in contact with the pressing portion 18*a*, a concave arc shape conforming to a convex arc shape of the pressing portion 18*a* is formed. In addition, on the surface of the pressed portion 20*e* that is in contact with the pressing portion 18*a*, a concave shape conforming to a convex shape of the pressing portion 18*a* may be formed. With this configuration, the phase of the sealing unit 20 is stabilized when the sealing unit 20 is assembled. In addition, it is possible to prevent the sealing unit 20 from moving in a circumferential direction due to vibrations or the like during distribution. A recess portion 20*g* that is retracted inwardly of a radius of rotation K of the pressed portion 20*e* is disposed on the upstream side of the pressed portion 20*e* in the rotation direction R. That is, the sealing unit 20 has a depressed portion that is provided within the radius of rotation K of the pressed portion 20*e*. In the case where the sealing unit 20 rotates in the direction of the arrow R, when the pressed portion 20*e* moves away from the pressing portion 18*a* and the recess portion 20*g* reaches the position of the pressing portion 18*a*, the supporting portion 20*a* is warped to a side opposite to the side of the sealing portion 20*b* by an elastic reaction force of the sealing portion 20*b*. With this, on an inner side in the longitudinal direction, the pressure of the sealing portion 20*b* that biases the surrounding part of the opening 17*a* in the first frame 17 is reduced and, as a result, the unsealing load is reduced. The sealing unit 20 receives the drive from the image forming apparatus main body B and, as illustrated in FIG. 6D, rotates by a predetermined angle θ1 (hereinafter referred to as an unsealing angle) in the direction of the arrow R in the drawing to move to a second position from a first position illustrated in FIG. 6B. Consequently, with the rotation of the sealing unit 20, a state of the sealing unit 20 can change from the first state in which the sealing unit 20 seals the opening 17*a* to the second state in which the sealing unit 20 opens the opening 17*a*. With this operation, the unsealing operation of the sealing unit 20 is performed. As illustrated in FIG. 6D, in the second state in which the sealing unit 20 opens the opening 17*a*, at least part of the pressing portion 18*a* is positioned in the depressed portion of the pressed portion 20*e*, and a gap is formed between the inner surface of the depressed portion (the recess portion 20*g*) and the pressing portion 18*a*. That is, when the sealing unit 20 is in the unsealing state, the gap is formed between the inner surface of the depressed portion (the recess portion 20*g*) and the pressing portion 18*a*. In addition, the sealing portion 20*b* has elasticity, and hence, as illustrated in FIG. 6D, the pressed portion 20*e* is separated from the pressing portion 18*a*, and the shapes of the lips 20*b*1 to 20*b*4 return to original states before the deformation from deformed states.

Further, the sealing unit 20 does not remain at the second position and, as illustrated in FIG. 6E, rotates by a second predetermined angle θ2 (hereinafter referred to as a maximum angle) in the direction of the arrow R in the drawing from the first position to move to a third position where the sealing unit 20 does not come into contact with the pressing portion 18*a*. Immediately after that, the sealing unit 20 reversely rotates in a direction of an arrow C in FIG. 6E to return to the second position illustrated in FIG. 6D. Thereafter, similarly, the sealing unit 20 continuously performs back-and-forth movement between the second position and the third position. In the embodiment, the driving structure is set such that the unsealing angle θ1 is 77 degrees, and the maximum angle θ2 is 95 degrees. The above operation of the sealing unit 20 can be implemented by using, e.g., a link mechanism or the like. However, in the embodiment, the above operation of the sealing unit 20 is implemented by using a partially toothed gear and a spring. The unsealing angle θ1 and the maximum angle θ2 can be freely set according to specifications of the gear. The detail of the driving structure will be described later.

Incidentally, as illustrated in FIG. 5A, in the supporting portion 20*a*, a plurality of ribs 20*f* are provided at positions opposite to the position of the sealing portion 20*b*. As illustrated in FIG. 5A, the ribs 20*f* are inclined 45 degrees with respect to the axis g joining the shaft portions 20*c* and 20*d*. In addition, the plurality of ribs 20*f* are disposed such that the inclination direction of the rib 20*f* on one side of the center of the sealing unit 20 in the longitudinal direction is different from the inclination direction of the rib 20*f* on the other side thereof. The ribs 20*f* are inclined toward the outer side of the sealing unit 20 in the longitudinal direction with approach to the downstream side from the upstream side in the rotation direction R of the sealing unit 20. By disposing the ribs 20*f* in this manner, when the sealing unit 20 is positioned between the second position and the third position, the ribs 20*f* are inclined toward the inner side of the sealing unit 20 in the longitudinal direction with approach to a lower side from an upper side in the direction of gravity. With the configuration of the ribs 20*f*, the sealing unit 20 performs the back-and-forth movement between the second position and the third position, and it is thereby possible to gently gather the toner at the center of the sealing unit 20 in the longitudinal direction while stirring the toner in the developer accommodating chamber 26. Accordingly, for example, even in the case where the toner is unevenly present at one end of the sealing unit 20 in the longitudinal direction, it is possible to quickly move the toner to the center of the sealing unit 20 in the longitudinal direction, and hence it is possible to reduce idling time before image output.

In addition, in the embodiment, the sealing unit 20 performs the back-and-forth movement after the opening (unsealing), whereby the sealing unit 20 is allowed to have stirring function. For example, in the case where the sealing unit 20 performs rotary motion, the sealing unit 20 interferes with the pressing portion 18*a*. Consequently, in the case where the sealing unit 20 performs the rotary motion, sealing that uses welding is required. That is, in the case where sealing means having stirring function is automatically opened in an apparatus main body, it is common to adopt a configuration in which a film is welded around an opening in a frame, and the film is wound around a shaft provided in the frame to be peeled. However, according to the embodiment, it is possible to implement the sealing unit 20 having the stirring function that does not require welding. In addition, in the embodiment, the unsealing is performed by moving the biasing sealing portion 20*b*, and hence the unsealing load can be made lower than the unsealing load in the case where a welded member is peeled (i.e., mechanically destroyed).

In addition, in the case of the sealing that uses the welding, it is necessary to form a welding surface, i.e., a surface around the opening into a flat surface for welding stability. However, the configuration of the embodiment does not have such restriction, and hence it is possible to form the surface around the opening 17*a* into an inclined shape or arc shape that is directed downward in the direction of gravity toward the opening 17*a*. With this, the fall of the toner around the opening 17*a* into the opening 17*a* is facilitated and, as compared with the conventional welding sealing configuration, discharge performance is improved in the configuration of the embodiment.

In addition, as illustrated in FIG. 6B, the rotation center g of the sealing unit 20 is provided at a position that is offset about 2 mm to the upstream side (the right side in the drawing) in the direction of movement of the sealing portion 20*b* at the time of the start of the unsealing with respect to the arc center h of the contacted portion 17*d*. With this configuration, when the unsealing is performed, while the lips 20*b*3 and 20*b*4 disposed on the short sides of the base portion 20*b*0 (see FIG. 5A and FIG. 5B) gradually move away from the contacted portion 17*d* in the radial direction of the arc of the contacted portion 17*d*, the sealing portion 20*b* moves. In the case where the arc center h matches the rotation center g (hereinafter referred to as a concentric configuration), the sealing portion 20*b* continuously slides on and rubs against the bottom surface of the first frame 17 in the unsealing operation, and hence a state in which unsealing torque is high is continued. According to the configuration of the embodiment, a frictional load is gradually reduced from the start of the unsealing, and hence it is possible to gradually reduce the unsealing torque from the start of the unsealing as compared with the concentric configuration. In addition, by using a disposition in which the arc center h is displaced from the rotation center g, it is possible to move the sealing unit 20 that performs the back-and-forth movement between the second position and the third position in the direction of the radius of rotation K with respect to the bottom surface of the first frame 17. Accordingly, it is possible to provide a wide gap d (FIG. 6D) between the sealing unit 20 and the bottom surface of the first frame 17. As a result, the toner in the developer accommodating chamber 26 can be smoothly discharged from the opening 17*a* to the outside without being obstructed by the sealing unit 20. In addition, in the configuration of the embodiment, the stress of the toner can be reduced to a level lower than that in the configuration in which the sealing portion 20*b* slides on and rubs against the inner surface of the first frame 17. On the other hand, in the case of the concentric configuration, the lip 20*b*2 on the upstream side in the rotation direction R moves to the contacted portion 17*b* on the upstream side in the rotation direction R, and the sealing unit 20 can be thereby spaced from the bottom surface of the first frame 17. That is, in order to provide the gap d between the sealing unit 20 and the bottom surface of the first frame 17, it is necessary to cause the sealing unit 20 to further rotate beyond the second position in the rotation direction R.

Driving Structure of Sealing Unit 20

Figure 7:
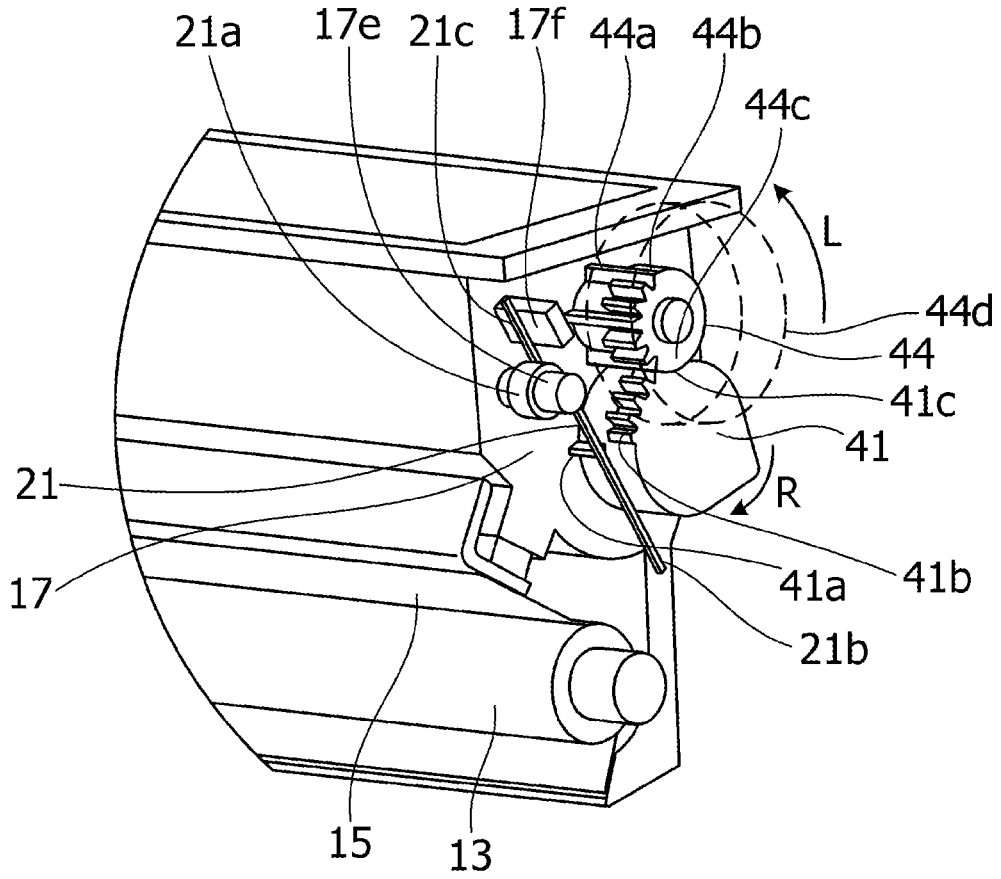
FIG. 7 is a perspective view of a driving portion of the sealing unit in the embodiment.
Figure 8:
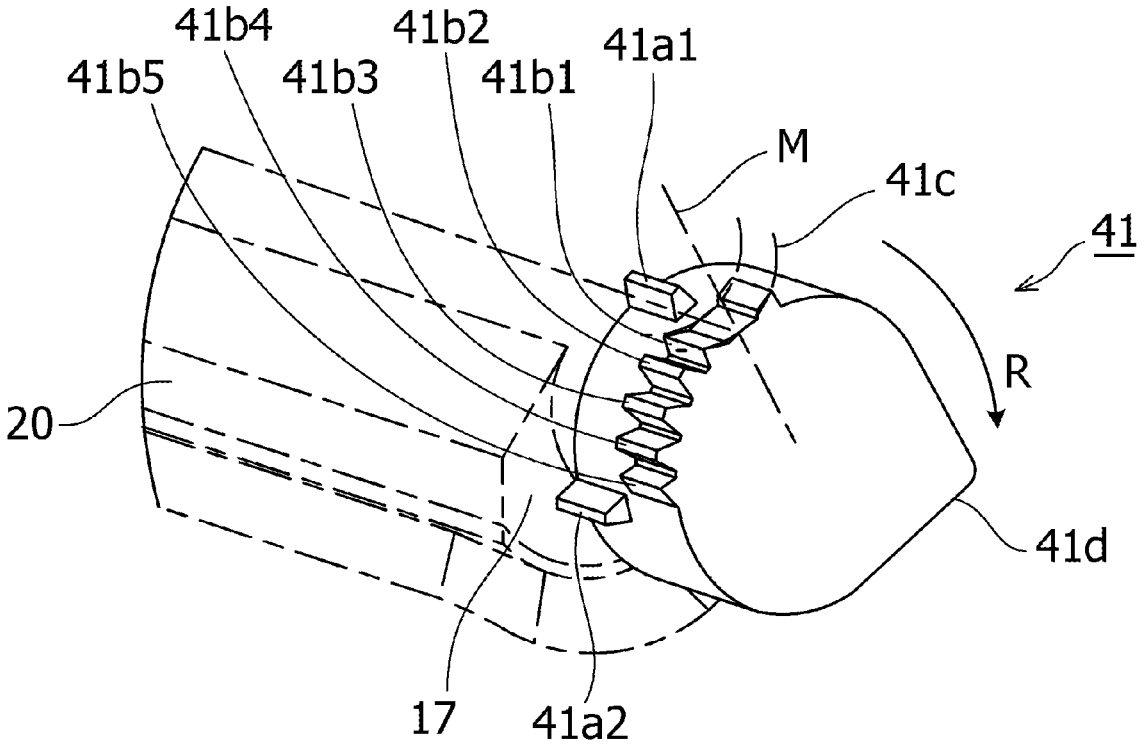
FIG. 8 is a perspective view of an unsealing gear in the embodiment.
Figure 9A:
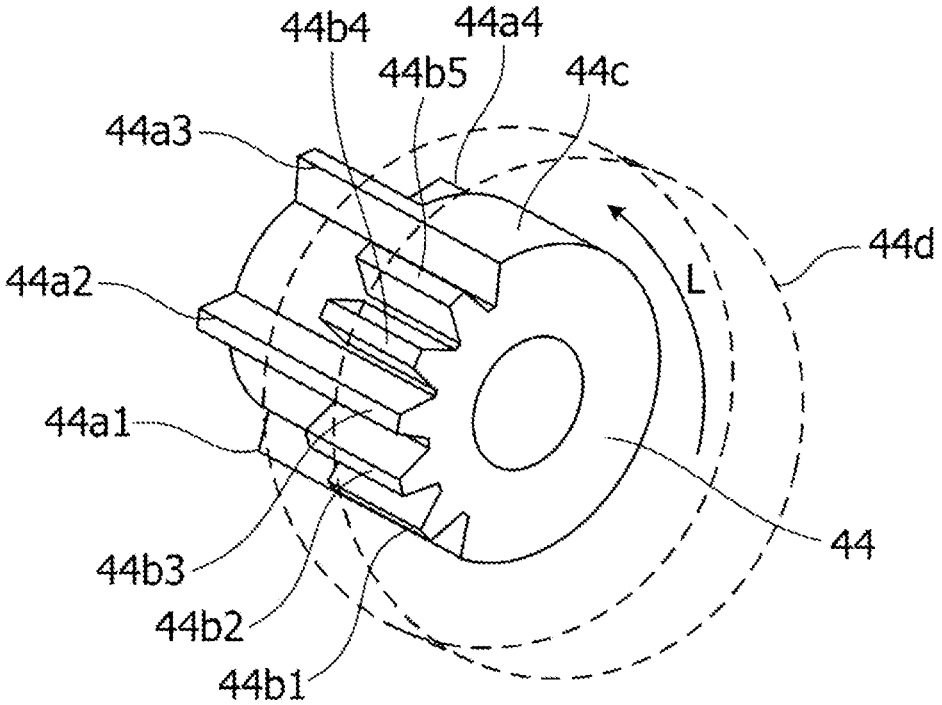
FIGS. 9A and 9B are perspective views of an intermediate gear in the embodiment.
Figure 9B:
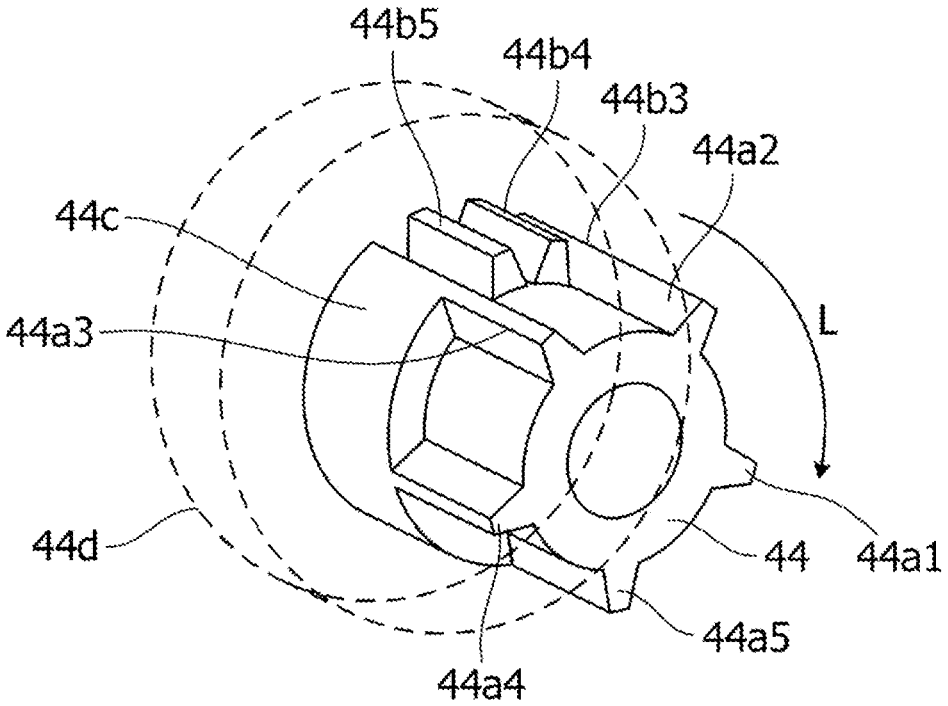

Next, the operation of the sealing unit 20 will be described by using FIG. 7, FIG. 8, FIGS. 9A and 9B, and FIGS. 10A to 10F. FIG. 7 is a perspective view illustrating a driving portion of the sealing unit 20, and FIG. 8 is a perspective view illustrating the unsealing gear 41. FIG. 9A is a perspective view illustrating the intermediate gear 44, and FIG. 9B is a perspective view when the intermediate gear 44 is viewed from a direction opposite to the direction in FIG. 9A. Each of FIGS. 10A to 10F is a view for explaining the operation of the sealing unit 20, and the sealing unit 20 operates in the order of FIG. 10A to FIG. 10F.

As illustrated in FIG. 7, the unsealing gear 41 coupled to the sealing unit 20 is provided at an outer end portion of the first frame 17 in the longitudinal direction. In addition, as illustrated in FIG. 8, a multi-stage gear constituted by a first unsealing gear portion 41*a* (41*a*1 and 41*a*2) and a second unsealing gear portion 41*b* (41*b*1 to 41*b*5) is disposed. The first unsealing gear portion 41*a* is closer to the first frame 17 than the second unsealing gear portion 41*b*. As illustrated in FIG. 8, the first unsealing gear portion 41*a* is a partially toothed gear in which, of all twenty-eight teeth of the gear, two teeth (41*a*1 and 41*a*2) that are disposed at an interval corresponding to five teeth remain, and the other teeth are removed. On the other hand, the second unsealing gear portion 41*b* is a partially toothed gear in which, of all twenty-eight teeth of the gear, five teeth (41*b*1 to 41*b*5) that are continuously disposed remain, and the other teeth are removed. The continuously disposed five teeth of the second unsealing gear portion 41*b* are provided between the two teeth of the first unsealing gear portion 41*a*. In addition, an arc-shaped depressed portion 41*c* is disposed on the downstream side in the rotation direction R of the second unsealing gear portion 41*b*. As illustrated in FIG. 8, when viewed from the longitudinal direction, the center of one tooth (hereinafter referred to as a tip tooth) 41*a*1 on the downstream side in the rotation direction R of the first unsealing gear portion 41*a* is positioned on a line M that joins the arc center of the arc-shaped depressed portion 41*c* and the rotation center of the unsealing gear 41. In the embodiment, part of the center of the arc-shaped depressed portion 41*c* is retracted to conform to the bottom arc of the second unsealing gear portion 41*b*. Part of the center of the arc-shaped depressed portion 41*c* is retracted in order to simplify the mold structure of the unsealing gear 41 and, as long as arc shapes are provided at both ends of the tip tooth 41*a*1 when viewed from the longitudinal direction, any functional problem does not arise, as will be described later.

As illustrated in FIG. 9A and FIG. 9B, the intermediate gear 44 that engages the unsealing gear 41 also has the multi-stage gear configuration. There are provided a first intermediate gear portion 44*a* (44*a*1 to 44*a*5) and a second intermediate gear portion 44*b* (44*b*1 to 44*b*5) that engage the first unsealing gear portion 41*a* and the second unsealing gear portion 41*b* respectively, and a third intermediate gear portion 44*d* that engages the input gear 43 that is not illustrated. The third intermediate gear portion 44*d* is a typical fully toothed gear. In order to facilitate understanding of the first intermediate gear portion 44*a* and the second intermediate gear portion 44*b*, the third intermediate gear portion 44*d* is indicated by a broken line in FIG. 9A and FIG. 9B. The first intermediate gear portion 44*a* is a partially toothed gear in which, of all fifteen teeth of the gear, five teeth (44*a*1 to 44*a*5) that are disposed at regular intervals each corresponding to two teeth remain, and the other teeth are removed. The second intermediate gear portion 44*b* is a partially toothed gear in which, of all fifteen teeth of the gear, continuously disposed five teeth remain, and the remaining periphery of the gear is formed of an arc portion 44*c* having the same outer diameter as that of a tip circle.

Figure 10A:
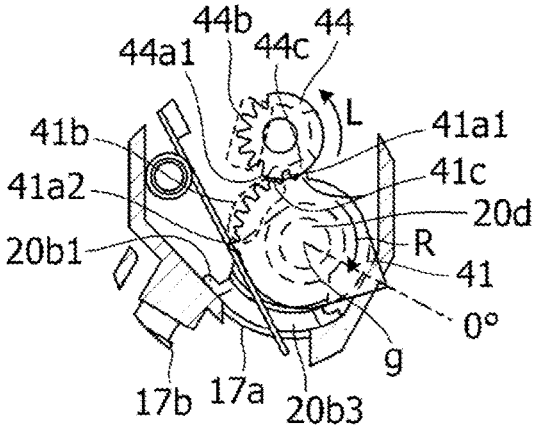
FIGS. 10A to 10F are views for explaining the operation of the sealing unit in the embodiment.

Next, the operation of the sealing unit 20 when the input gear 43 receives rotational drive from the image forming apparatus main body B and rotates will be described by using FIGS. 10A to 10F. In FIGS. 10A to 10F, in order to facilitate understanding, the depiction of the third intermediate gear portion 44*d* is omitted. As illustrated in FIG. 10A, in the case where the sealing unit 20 is in the sealing state, the arc-shaped depressed portion 41*c* of the unsealing gear 41 engages the arc portion 44*c* of the intermediate gear 44. When the intermediate gear 44 receives the rotational drive of the input gear 43 that is not illustrated and rotates in a direction of an arrow L, first, one tooth 44*a*1 of the first intermediate gear portion 44*a* disposed on the upstream side in the rotation direction L of the arc portion 44*c* transmits the rotational drive to the tip tooth 41*a*1 disposed on the upstream side in the rotation direction R of the arc-shaped depressed portion 41*c*. Subsequently, the unsealing gear 41 starts to rotate in the direction of the arrow R. Correspondingly, as illustrated in FIG. 10B and FIG. 10C, the teeth of the second intermediate gear portion 44*b* sequentially engage the corresponding teeth of the second unsealing gear portion 41*b*, and the unsealing gear 41 is thereby caused to rotate. At the time of the sealing state, as described above, the first intermediate gear portion 44*a* has the intervals each corresponding to two teeth. On the other hand, the arc-shaped depressed portion 41*c* of the unsealing gear 41 is engaged with the arc portion 44*c* of the intermediate gear 44, and hence the rotational drive does not propagate reversely to the upstream side (opposite side) from the sealing unit 20. That is, with the lock mechanism described above, it is possible to prevent the sealing unit 20 from rotating by mistake due to vibrations or the like during distribution.

Figure 10D:
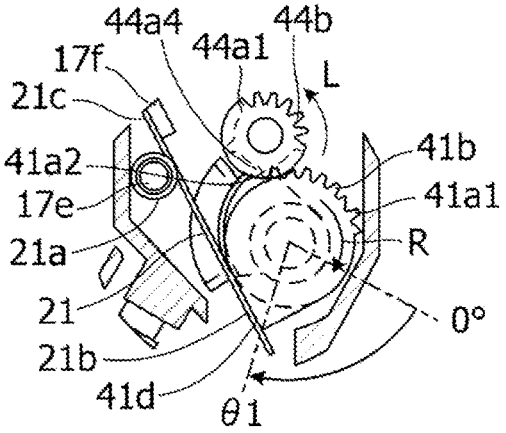
Figure 10B:
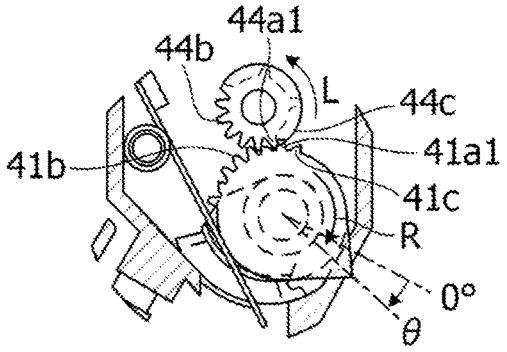

FIG. 10D illustrates a state in which the engagement between the second intermediate gear portion 44*b* and the second unsealing gear portion 41*b* is completed. The sealing unit 20 rotates by the unsealing angle θ1 in the direction of the arrow R in FIG. 10D to move from the first position in the sealing state to the second position, and the unsealing is completed. In this case, a biasing spring 21 provided in the first frame 17 comes into contact with a biased portion 41*d* of the unsealing gear 41. The biasing spring 21 is a helical torsion spring, and a winding portion 21*a* is engaged with a boss 17*e* disposed on the side surface of the first frame 17. The biasing spring 21 is disposed such that one arm portion 21*b* comes into contact with the biased portion 41*d* of the unsealing gear 41, and the other arm portion 21*c* comes into contact with a regulating rib 17*f* of the first frame 17. In this state, the biased portion 41*d* is formed to be parallel to the arm portion 21*b*. With this, the unsealing gear 41 does not rotate from this phase in a direction opposite to the direction of the arrow R. That is, the sealing unit 20 that has once moved to the second position does not move in the direction of the first position again. Consequently, after a state of the sealing unit 20 has changed from the sealing state to the unsealing state, the state of the sealing unit 20 does not change from the unsealing state to the sealing state. When the intermediate gear 44 further rotates in the direction of the arrow L, one tooth 44*a*4 of the first intermediate gear portion 44*a* transmits the drive to the other tooth 41*a*2 (hereinafter referred to as an end tooth) of the first unsealing gear portion 41*a* that does not contribute to the unsealing, and the unsealing gear 41 further rotates in the direction of the arrow R. In this case, the biasing spring 21 operates to prevent the unsealing gear 41 from rotating in the direction of the arrow R. After the unsealing gear 41 has rotated in the direction of the arrow R by a distance corresponding to one tooth from the state in FIG. 10D, the transmission of the drive from the intermediate gear 44 is stopped because the first intermediate gear portion 44*a* is the partially toothed gear.

Figure 10E:
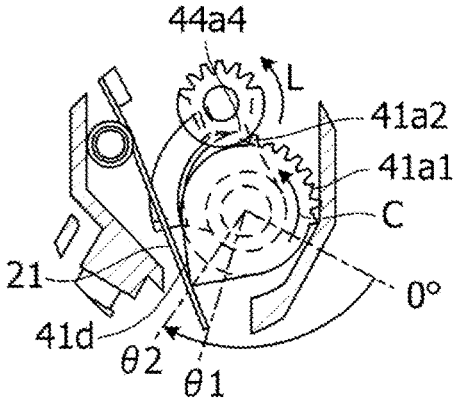
Figure 10C:
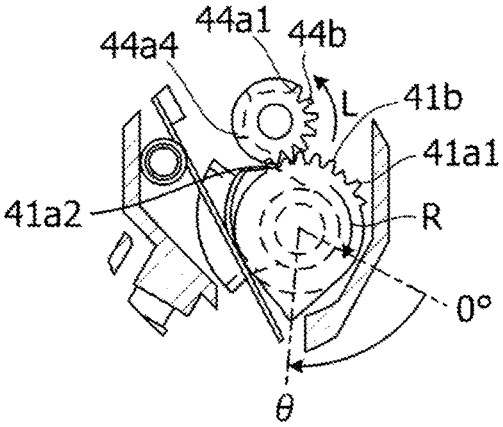
Figure 10F:
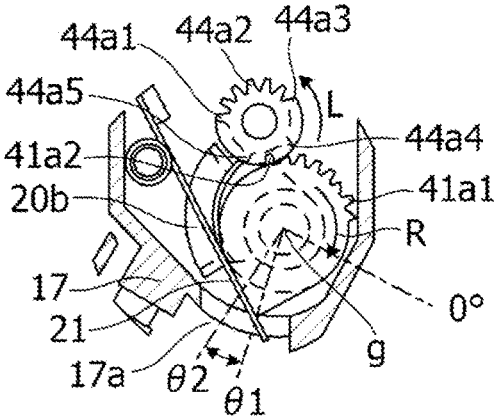

As illustrated in FIG. 10E, the unsealing gear 41 is caused to rotate in a direction of an arrow C in the drawing by the biasing spring 21, and returns to the position in FIG. 10D. The position (the third position) of the sealing unit 20 at the moment when the transmission of the drive from the intermediate gear 44 is stopped is the position spaced from the first position in the sealing state by a distance corresponding to the maximum angle θ2 in the direction of the arrow R. As illustrated in FIG. 10F the intermediate gear 44 continuously rotates in the direction of the arrow L thereafter. One tooth 44*a*5 on the upstream side of one tooth 44*a*4 in the rotation direction L of the first intermediate gear portion 44*a* having driven the unsealing gear 41 from the second position to the third position comes into contact with the end tooth 41*a*2, and the unsealing gear 41 starts to rotate in the direction of the arrow R again. Thus, the first intermediate gear portion 44*a* repeats the intermittent contact with the end tooth 41*a*2 of the unsealing gear 41, whereby the sealing unit 20 repeats the back-and-forth movement between the second position and the third position. Thus, it is possible to implement the unsealing operation and the stirring operation by using the simple component configuration having a pair of the partially toothed gears and the spring. In addition, by using the driving structure according to the embodiment, movement start acceleration in a direction in which the sealing unit 20 returns from the third position to the second position using the biasing spring 21 is higher than movement start acceleration in a direction in which the sealing unit 20 moves from the second position to the third position using the uear. By providing a difference in movement start acceleration in the back-and-forth movement of the sealing unit 20 in this manner, toner adhering to the sealing unit 20 is shaken off, and hence it is possible to use a larger amount of toner in the developer accommodating chamber 26.

According to the present invention, it is possible to improve the sealing performance while reducing the unsealing load of the compressed seal.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2018-143129, filed on Jul. 31, 2018, and Japanese Patent Application No. 2018-143154, filed on Jul. 31, 2018, which are hereby incorporated by reference herein in their entirety.

What is claimed is:

1. A developer accommodating unit comprising:

a frame provided with a developer accommodating chamber configured to accommodate a developer, and an opening for discharging the developer from the developer accommodating chamber; and a sealing unit provided inside the frame, the sealing unit including a supporting portion rotatable in a first direction, and a sealing portion attached to the supporting portion, the sealing portion sealing the opening, the sealing portion having a protruding portion including a first part, the protruding portion being capable of coming into contact with the frame in a surrounding part of the opening, a state of the sealing unit being capable of changing from a first state in which the sealing portion seals the opening to a second state in which the opening is opened, wherein if the sealing unit is in the first state, a tip of the first part is positioned on a downstream side of a base of the first part in the first direction, and wherein if the state of the sealing unit changes from the first state to the second state, the first part is deformed such that the tip of the first part is positioned on an upstream side of the base of the first part in the first direction.

2. The developer accommodating unit according to claim 1, wherein the sealing portion seals the opening by being compressed by the frame and the supporting portion.

3. The developer accommodating unit according to claim 1, wherein if the sealing unit is in the first state, the first part comes into contact with the frame on a downstream side of the opening in the first direction.

4. The developer accommodating unit according to claim 1, wherein the protruding portion includes a second part, and wherein if the sealing unit is in the first state, a tip of the second part is positioned on an upstream side of a base of the second part in the first direction.

5. The developer accommodating unit according to claim 4, wherein if the state of the sealing unit changes from the first state to the second state, the tip of the second part is positioned on the upstream side of the base of the second part in the first direction.

6. The developer accommodating unit according to claim 1, further comprising:

a pressing portion provided inside the frame; and a pressed portion provided in the sealing unit, the pressed portion coming into contact with the pressing portion if the sealing unit is in the first state.

7. The developer accommodating unit according to claim 6, wherein the sealing unit has a recess portion that is provided within a radius of rotation of the pressed portion, and if the sealing unit is in the second state, at least part of the pressing portion is positioned in the recess portion, and a gap is formed between an inner surface of the recess portion and the pressing portion.

8. The developer accommodating unit according to claim 6, wherein the pressing portion is disposed at a position facing the opening.

9. The developer accommodating unit according to claim 1, wherein the state of the sealing unit does not change from the second state to the first state after the state of the sealing unit has changed from the first state to the second state.

10. A process cartridge detachably provided in a main body of an image forming apparatus for performing image formation, the process cartridge comprising:

the developer accommodating unit according to claim 1; and an image bearing member configured to bear a developer image.

11. An image forming apparatus configured to perform image formation comprising:

the developer accommodating unit according to claim 1;

an image bearing member configured to bear a developer image; and a transfer portion configured to transfer the developer image borne by the image bearing member to a recording material.

12. A developer accommodating unit comprising:

a frame provided with a developer accommodating chamber configured to accommodate a developer, and an opening for discharging the developer from the developer accommodating chamber; and a sealing unit provided inside the frame, the sealing unit including a supporting portion rotatable in a first direction, and a sealing portion attached to the supporting portion, the sealing portion sealing the opening by being compressed by the frame and the supporting portion, the sealing portion having a protruding portion including a first part and a second part, the protruding portion being capable of coming into contact with the frame in a surrounding part of the opening, a state of the sealing unit being capable of changing from a first state in which the sealing portion seals the opening to a second state in which the opening is opened, wherein if the sealing unit is in the first state, the first part comes into contact with the frame on a downstream side of the opening in the first direction and is inclined from a base of the first part toward a tip of the first part in a direction from an upstream side of the opening toward the downstream side of the opening, and the second part comes into contact with the frame on the upstream side of the opening in the first direction and is inclined from a base of the second part toward a tip of the second part in a direction from the downstream side of the opening toward the upstream side of the opening, and a length from the base of the first part to the tip of the first part is greater than a thickness of the first part, and a length from the base of the second part to the tip of the second part is greater than a thickness of the second part when viewed in a direction of a rotational axis of the supporting portion.

13. The developer accommodating unit according to claim 12, wherein if the sealing unit is in the first state, part of an inner surface of the first part comes into contact with the frame on the downstream side of the opening in the first direction, and part of an inner surface of the second part comes into contact with the frame on the upstream side of the opening in the first direction.

14. The developer accommodating unit according to claim 12, further comprising:

a pressing portion provided inside the frame; and a pressed portion provided in the sealing unit, the pressed portion coming into contact with the pressing portion if the sealing unit is in the first state.

15. The developer accommodating unit according to claim 14, wherein the protruding portion has elasticity, if the sealing unit is in the first state, the first part comes into contact with the frame on the downstream side of the opening in a state in which the first part is deformed and the second part comes into contact with the frame on the upstream side of the opening in a state in which the second part is deformed, and if the sealing unit is in the second state, the pressed portion is separated from the pressing portion, the first part returns to an original shape, and the second part returns to an original shape.

16. The developer accommodating unit according to claim 14, wherein a concave shape is formed on a surface of the pressed portion that is in contact with the pressing portion, and a convex shape is formed on a surface of the pressing portion that is in contact with the pressed portion.

17. The developer accommodating unit according to claim 14, wherein the sealing unit has a recess portion that is provided within a radius of rotation of the pressed portion, and a gap is formed between an inner surface of the recess portion and the pressing portion if the sealing unit is in the second state.

18. The developer accommodating unit according to claim 12, wherein rigidity of the sealing portion is lower than rigidity of the supporting portion.

19. The developer accommodating unit according to claim 12, wherein the supporting portion, the sealing portion, and the protruding portion are integrally formed.

20. A process cartridge detachably provided in a main body of an image forming apparatus for performing image formation, the process cartridge comprising:

the developer accommodating unit according to claim 12; and an image bearing member configured to bear a developer image.

21. An image forming apparatus configured to perform image formation comprising:

the developer accommodating unit according to claim 12;

an image bearing member configured to bear a developer image; and a transfer portion configured to transfer the developer image borne by the image bearing member to a recording material.

* * * * *